US010241435B1

(12) United States Patent
Sato

(10) Patent No.: US 10,241,435 B1
(45) Date of Patent: Mar. 26, 2019

(54) IMAGE FORMING APPARATUS HAVING A MAIN BODY, ATTACHING/DETACHING SECTION, UNEVEN PART, AND CLEANING MEMBER

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Yoji Sato, Izunokuni Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/713,907

(22) Filed: Sep. 25, 2017

(51) Int. Cl.

| | |
|---|---|
| ***G03G 15/01*** | (2006.01) |
| ***G03G 15/00*** | (2006.01) |
| ***G03G 15/08*** | (2006.01) |
| ***G03G 21/00*** | (2006.01) |

(52) U.S. Cl.
CPC ..... *G03G 15/0142* (2013.01); *G03G 15/5037* (2013.01); *G03G 21/0005* (2013.01); *G03G 15/0865* (2013.01)

(58) Field of Classification Search
None
See application file for complete search history.

(56) References Cited

U.S. PATENT DOCUMENTS 4,707,408 A * 11/1987 Iwasawa ..... G03G 21/0058 399/357
8,135,319 B2 * 3/2012 Fujita ..... G03G 15/657 399/316
2011/0262852 A1 * 10/2011 Yamauchi ..... G03G 9/08755 430/108.1

FOREIGN PATENT DOCUMENTS

| | | |
|---|---|---|
| JP | 06-072569 | 3/1994 |
| JP | 2002229347 A * | 8/2002 |
| JP | 2006-191447 | 7/2006 |

OTHER PUBLICATIONS

JP_2002229347_A_T MachinTranslation, Japan, Shikayama, Aug. 2002.*

* cited by examiner

*Primary Examiner* — Victor Verbitsky
(74) *Attorney, Agent, or Firm* — Amin, Turocy, Watson LLP

(57) ABSTRACT

In accordance with an embodiment, an image forming apparatus comprises a main body, an attaching/detaching section, an uneven part, and a cleaning member. A conveyance path is formed inside the main body. The attaching/detaching section housed in the main body is detachably drawn out with respect to the main body along the conveyance path. The uneven part has a convex part and a concave part and is arranged in the attaching/detaching section. The cleaning member arranged in the main body is slidable with the convex part in a direction in which the attaching/detaching section moves along the conveyance path.

11 Claims, 11 Drawing Sheets

IMAGE FORMING APPARATUS HAVING A MAIN BODY, ATTACHING/DETACHING SECTION, UNEVEN PART, AND CLEANING MEMBER

FIELD

Embodiments described herein relate generally to an image forming apparatus.

BACKGROUND

Conventionally, an image forming apparatus includes an attaching/detaching section periodically exchanged by a user. The attaching/detaching section can be an image forming unit (Electrical Processing Unit), an intermediate transfer belt unit, and the like. The attaching/detaching section is changed due to use and/or wear and tear.

For example, the image forming apparatus has a main body. An opening is formed in front of the main body. A door rotatable with respect to the main body is mounted in the main body. If the door contacts the main body, the door blocks the opening of the main body. If the door is separated from the main body (open the door), the opening of the main body is opened to the outside.

The attaching/detaching section can have a knob and a handle. The knob is positioned on the outside through the opening of the main body at the time of opening the door. Therefore, deposit such as toner or a paper dust are difficult to adhere to the knob. The user opens the door to hold the knob of the attaching/detaching section with one hand. The knob is drawn out to the front side of the main body, and the attaching/detaching section is drawn or taken out from the main body. The user draws out the attaching/detaching section, and the handle of the attaching/detaching section is held by the other hand. The handle is arranged in the main body, and thus, there is a case in which deposits are attached to the handle.

The user draws out the attaching/detaching section from the main body. Anew attaching/detaching section is then housed in the main body.

DETAILED DESCRIPTION

In accordance with an embodiment, an image forming apparatus comprises a main body, an attaching/detaching section, an uneven part, and a cleaning member. A conveyance path is formed inside the main body. The attaching/detaching section housed in the main body is detachably drawn out with respect to the main body along the conveyance path. The uneven part has a convex part and a concave part and is arranged in the attaching/detaching section. The cleaning member arranged in the main body is slidable with the convex part in a direction in which the attaching/detaching section moves along the conveyance path.

Hereinafter, an image forming apparatus of the embodiment is described with reference to the accompanying drawings.

Figure 1:
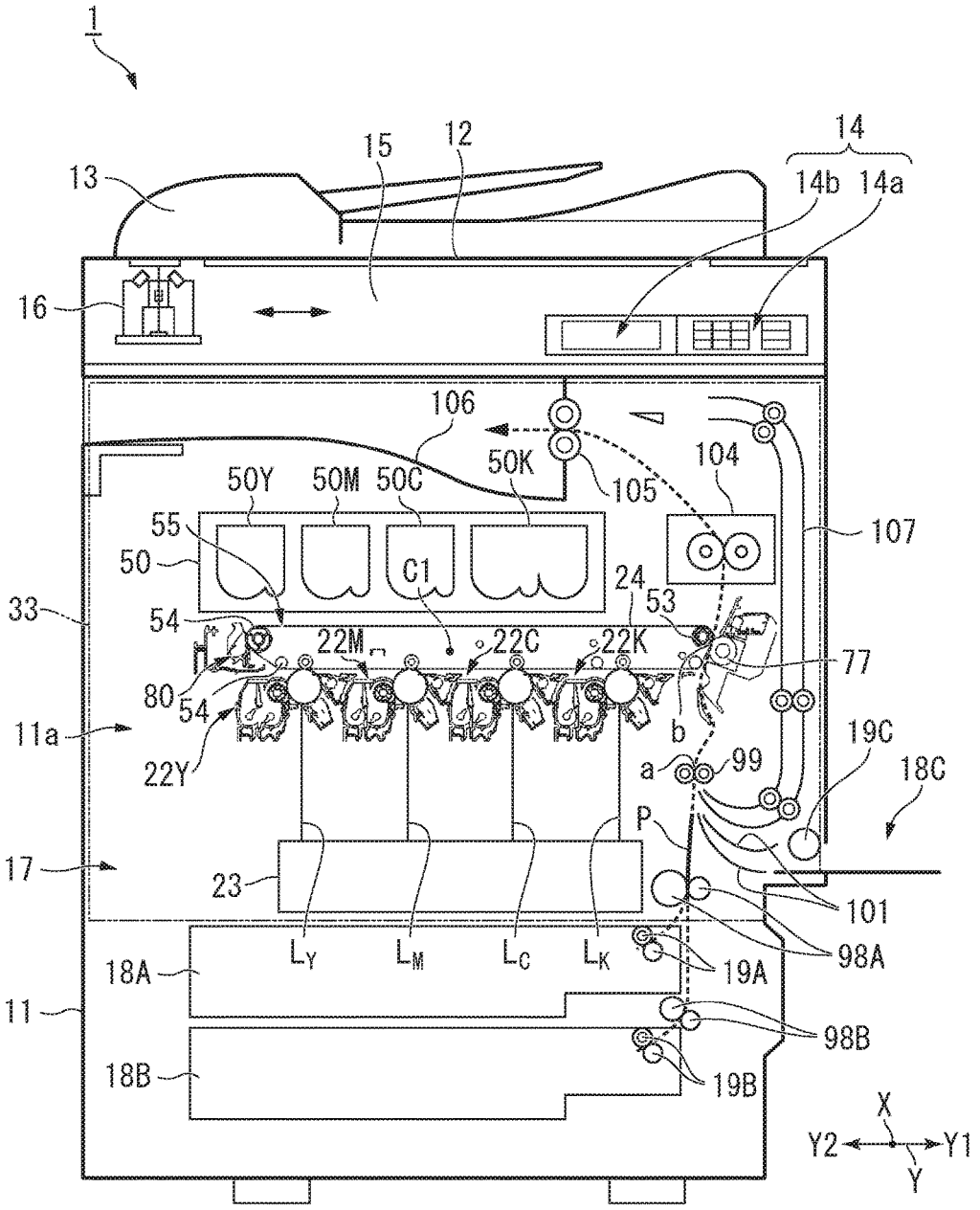
FIG. 1 is a schematic diagram of an image forming apparatus.

As shown in FIG. 1, an image forming apparatus 1 of the present embodiment is, for example, an MFP (Multi-Function Peripheral), a printer, a copying machine, and the like. An example in which the image forming apparatus 1 is an MFP is described below.

The image forming apparatus 1 has a main body 11. At the top of the main body 11, a document table 12 including a transparent glass is provided. An automatic document feeder (ADF) 13 is provided on the document table 12. At the top of the main body 11, an operation section 14 is provided. The operation section 14 includes an operation panel 14*a* having various keys and a touch panel type operation and display section 14*b*.

A scanner section 15 is provided below the ADF 13. The scanner section 15 reads an original document sent by the ADF 13 or an original document placed on the document table 12. The scanner section 15 generates image data of the original document. For example, the scanner section 15 includes an image sensor 16. For example, the image sensor 16 may be a contact type image sensor.

The image sensor 16 moves along the document table 12 at the time of reading the image of the original document placed on the document table 12. The image sensor 16 reads an original document by each line for one page of the document image.

If the image of the original document sent by the ADF 13 is read, the image sensor 16 reads the sent original document at a fixed position shown in FIG. 1.

The main body 11 has a transfer section 17 at a center in the height direction. The main body 11 has sheet feed cassettes 18A and 18B and a manual sheet feed unit 18C at the bottom.

The sheet feed cassettes 18A and 18B are arranged inside the main body 11. The sheet feed cassettes 18A and 18B are arranged to be overlapped in an order from the upper side to the lower side.

The manual sheet feed unit 18C protrudes to the side of the main body 11 below an inversion conveyance path 107 described later.

The sheet feed cassettes 18A and 18B and the manual sheet feed unit 18C accommodate sheets P of various sizes. The central axis in a conveyance orthogonal direction of each of the sheets P of various sizes which is a direction orthogonal to a conveyance direction of a sheet P along a conveyance surface of the sheet P is positioned at a fixed position.

The sheet feed cassette 18A (18B) includes a sheet feed mechanism 19A (19B). That the sheet feed cassette 18A (18B) has the sheet feed mechanism 19A (19B) includes both that the sheet feed cassette 18A has the sheet feed mechanism 19A and that the sheet feed cassette 18B has the sheet feed mechanism 19B. The same form is also used in the following description.

The sheet feed mechanism 19A (19B) picks up the sheets P one by one from the sheet feed cassette 18A (18B) and sends it to a sheet conveyance path of the sheets P. For example, the sheet feed mechanism 19A (19B) may include a pickup roller, a separation roller, and a sheet feed roller.

The manual sheet feed unit 18C has a manual sheet feed mechanism 19C. The manual sheet feed mechanism 19C picks up the sheets P one by one from the manual sheet feed unit 18C and sends it to the sheet conveyance path.

The transfer section 17 forms an image on the sheet P based on image data read by the scanner section 15 or image data created by a personal computer. The transfer section 17 is a color printer of a tandem system.

As shown in FIG. 1, the transfer section 17 includes image forming sections (attaching/detaching sections) 22Y, 22M, 22C and 22K of yellow (Y), magenta (M), cyan (C), and black (K) colors, an exposure device 23, and an intermediate transfer belt (rotating body) 24. In the present embodiment, the transfer section 17 has four image forming sections 22Y, 22M, 22C and 22K. The transfer section 17 has so-called quadruple image forming sections.

The constitution of the transfer section 17 is not limited thereto, and the transfer section may include two or three image forming sections, or the transfer section may include five or more image forming sections.

The image forming sections 22Y, 22M, 22C and 22K are arranged below the intermediate transfer belt 24. The image forming sections 22Y, 22M, 22C and 22K are arranged in parallel along the downstream side from the upstream side in a moving direction (a direction from the left side to the right side in FIG. 1) of the lower side of the intermediate transfer belt 24.

The exposure device 23 emits exposure light $L_Y$, $L_M$, $L_C$ and $L_K$ to the image forming sections 22Y, 22M, 22C and 22K, respectively. The exposure device 23 may generate a laser scanning beam as the exposure light. The exposure device 23 may include a solid-state scanning element such as an LED for generating the exposure light.

The constitutions of the image forming sections 22Y, 22M, 22C and 22K are common to each other except that the colors of the toner therein are different. Either one of a normal color toner and a decoloring toner may be used as the toner. The decoloring toner becomes transparent if heated at a certain temperature or higher. The image forming apparatus 1 may be the image forming apparatus that can use the decoloring toner or the image forming apparatus that cannot use the decoloring toner.

Hereinafter, the common constitution of the image forming sections 22Y, 22M, 22C and 22K is described by using the image forming section 22K as an example.

Figure 2:
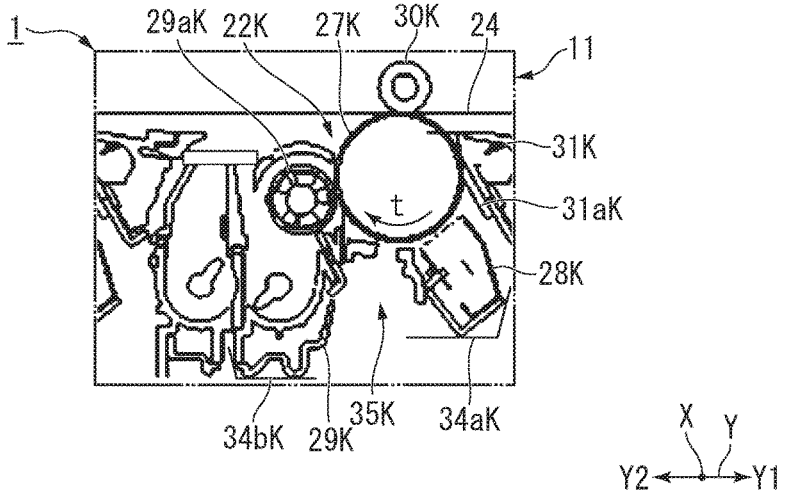
FIG. 2 is an enlarged view of the periphery of an image forming section of the image forming apparatus.
Figure 3:
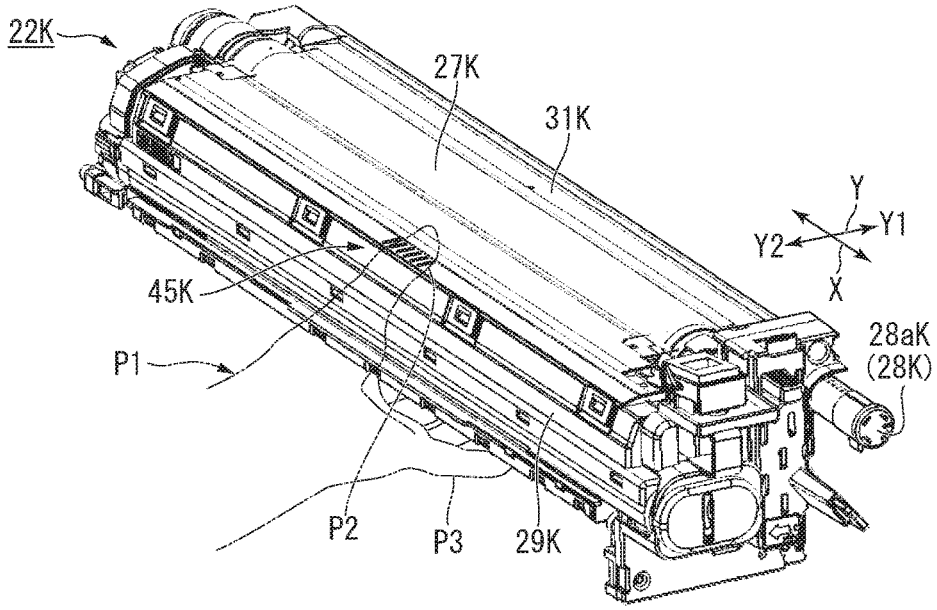
FIG. 3 is a perspective view of the image forming section in the image forming apparatus.

As shown in FIG. 2 and FIG. 3, the image forming section 22K has a photoconductive drum 27K. The photoconductive drum 27K rotates in a rotation direction t. A charging device 28K, a developing device 29K, a primary transfer roller 30K and a cleaner 31K are arranged around the photoconductive drum 27K along the rotation direction t. The image forming section 22K includes the charging device 28K, the developing device 29K, the primary transfer roller 30K, and the cleaner 31K.

The charging device 28K of the image forming section 22K uniformly charges the surface of the photoconductive drum 27K.

The exposure device 23 generates the exposure light $L_K$ modulated based on the image data. The exposure light $L_K$ exposes the surface of the photoconductive drum 27K. The exposure device 23 forms an electrostatic latent image on the photoconductive drum 27K.

The developing device 29K supplies black toner to the photoconductive drum 27K by a developing roller 29*a*K to which a developing bias is applied. The developing device 29K develops the electrostatic latent image on the photoconductive drum 27K.

The cleaner 31K has a blade 31*a*K abutting against the photoconductive drum 27K. The blade 31*a*K removes residual toner on the surface of the photoconductive drum 27K.

Figure 4:
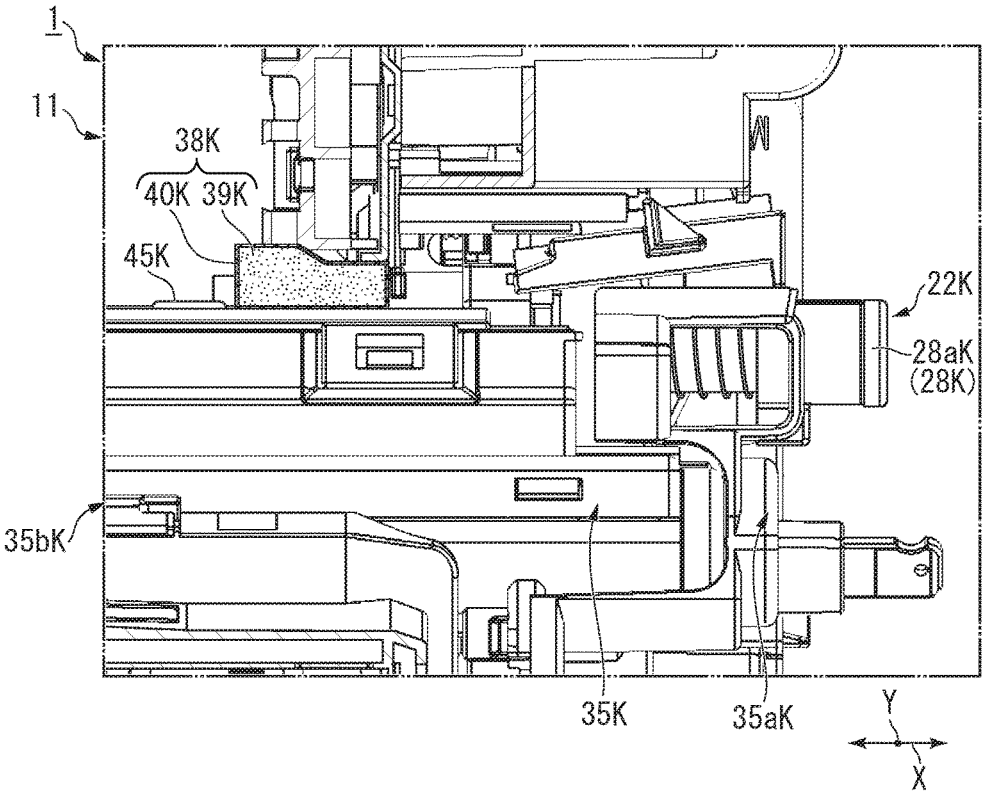
FIG. 4 is a sectional view of main portions of a side view of the image forming apparatus.

The image forming section 22K is formed into a long block shape in a front-back direction X of the image forming apparatus 1. As shown in FIG. 3 and FIG. 4, a front end of the charging device 28K is a Knob 28*a*K carried by a user. As shown in FIG. 1, an opening 11*a* is formed in front of the main body 11. In the main body 11, a front door 33 rotatable with respect to the main body 11 is mounted. In FIG. 1, the front door 33 is indicated by a two-dot chain line. If the front door 33 is closed, the front door 33 blocks the opening 11*a* of the main body 11. If the front door 33 is opened, the knob 28*a*K of the charging device 28K is exposed to the outside through the opening 11*a*.

Although not shown, for example, the image forming section 22K has a unit side connector connected to the charging device 28K or the like. The main body 11 has a main body side connector. If the image forming section 22K is mounted in the main body 11, the unit side connector is connected to the main body side connector, and electric power and control signals can be supplied to the charging device 28K. If the image forming section 22K is drawn out from the inside of the main body 11, the connection between the main body side connector and the unit side connector is released.

As shown in FIG. 2, for example, rails 34*a*K and 34*b*K extending along the front-back direction X are fixed in the main body 11. The image forming section 22K can move along the front-back direction X on the rails 34*a*K and 34*b*K. By the rails 34*a*K and 34*b*K, a first conveyance path (conveyance path) 35K shown in FIG. 2 and FIG. 4 is formed in the main body 11. As shown in FIG. 4, a front end of the first conveyance path 35K is an opening 35*a*K passed at the time the image forming section 22K in the main body 11 is attached and detached. An end at the opposite side to the opening 35*a*K on the first conveyance path 35K is a rear part 35*b*K which is a rear end of the first conveyance path 35K. The image forming section 22K is housed in the main body 11 and is detachably drawn out from the main body 11 along the first conveyance path 35K. In this example, a direction in which the image forming section 22K moves along the first conveyance path 35K, and a direction in which the image forming section 22K is drawn out from the inside of the main body 11 to the outside of the main body 11 through the opening 35*a*K is the front-back direction X.

Figure 5:
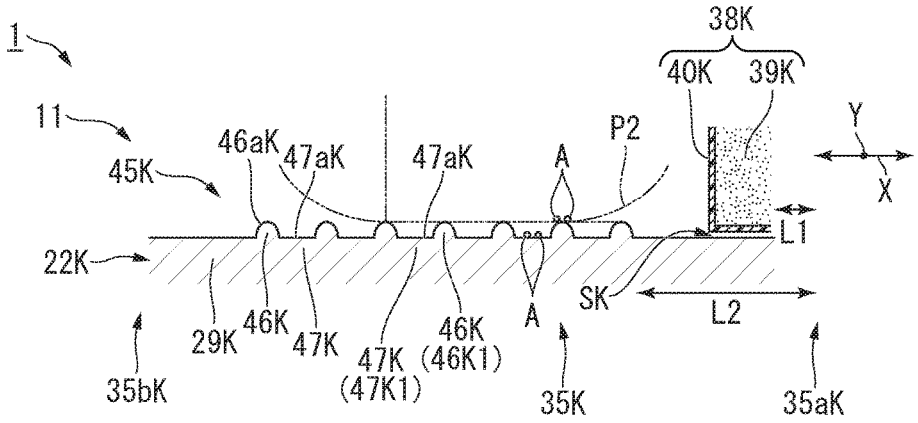
FIG. 5 is a sectional view of main portions of an uneven part and a cleaning pad of the image forming apparatus.

In the main body 11, a cleaning pad (cleaning member) 38K is fixed. The cleaning pad 38K is fixed to an intermediate portion in the front-back direction X of the first conveyance path 35K. The cleaning pad 38K may be fixed to the rails 34*a*K and 34*b*K. As shown in FIG. 4 and FIG. 5, the cleaning pad 38K has a foam 39K and a film layer 40K. The foam 39K is a sponge, a urethane foam or the like, and is formed into a block shape. It is preferable that a lower surface of the foam 39K is arranged along a horizontal surface. The film layer 40K is formed of resin such as PET (PolyEthylene Terephthalate). The film layer 40K is arranged on the surface of the foam 39K.

Figure 6:
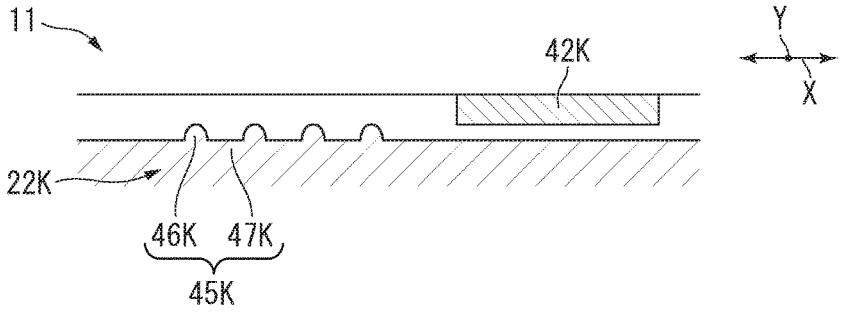
FIG. 6 is a sectional view of main portions of an uneven part and a cleaning pad of a modification of the image forming apparatus.

As shown in FIG. 6, a cleaning pad 42K may be formed by nonwoven fabric. With such a constitution, it is possible to clean an uneven part 45K by attaching the deposit such as a toner to the cleaning pad 42K. A space required to clean the uneven part 45K can be suppressed.

The cleaning pad may be formed by felt or the like. The cleaning pad may be a spatular member inclined so as to gradually incline backward as it goes downward.

As shown in FIG. 3 and FIG. 5, on the upper surface of the developing device 29K of the image forming section 22K, the uneven part 45K is provided. As shown in FIG. 5, the uneven part 45K has a plurality of convex parts 46K and a plurality of concave parts 47K. The plurality of the convex parts 46K and the plurality of the concave parts 47K are alternately arranged in the front-back direction X. For example, an upper surface (first outer surface) 46*a*K of the convex part 46K is curved so as to protrude upward in a cross section orthogonal to a left-right direction Y of the image forming apparatus 1. The left-right direction Y is orthogonal to the front-back direction X. For example, a bottom surface (second outer surface) 47*a*K of the concave part 47K is a flat surface parallel to the horizontal surface. The bottom surface 47*a*K of the concave part 47K is positioned below the upper surface 46*a*K of the convex part 46K (inside the uneven part 45K).

Herein, one of the plurality of the convex parts 46K is referred to as a convex part 46K1, and one of the plurality of the concave parts 47K is referred to as a concave part 47K1. The convex part 46K1 is arranged closer to the opening 35*a*K than the concave part 47K1 along the first conveyance path 35K. The convex part 46K and the concave part 47K extend in the left-right direction Y. As described later, it is preferable that a depth of the concave part 47K is set to an extent that the deposit at the inside of the concave part 47K is not attached to a finger at the time the finger of a user touches the upper surface 46*a*K of the convex part 46K in a state in which the deposit is accumulated in the concave part 47K.

The upper surface 46*a*K of each convex part 46K is arranged above the lower surface of the cleaning pad 38K. The uneven part 45K is arranged at a position adjacent to the cleaning member 38K. A distance L2 between the opening 35*a*K and the uneven part 45K along the first conveyance path 35K is longer than a distance L1 between the opening 35*a*K and the cleaning pad 38K along the first conveyance path 35K. A gap SK is formed between the cleaning pad 38K and the image forming section 22K, and the cleaning pad 38K does not contact the image forming section 22K. The cleaning pad 38K is slidable in the front-back direction X with the upper surface 46*a*K of the convex part 46K.

The positions of the centers of gravity of the image forming section 22K and the uneven part 45K and the position of the uneven part 45K are preferably equal to each other in the front-back direction X.

The image forming sections 22Y, 22M and 22C have developing devices differing only in the color of the toner from the developing device 29K of the image forming section 22K.

As shown in FIG. 1, at the top of the image forming sections 22Y, 22M, 22C and 22K, a supply section 50 is arranged.

The supply section 50 supplies the toner to the developing devices 29Y, 29M, 29C and 29K, respectively. The supply section 50 has toner cartridges 50Y, 50M, 50C and 50K. The toner cartridges 50Y, 50M, 50C, and 50K store a yellow toner, a magenta toner, a cyan toner, and a black toner, respectively.

In each of the toner cartridges 50Y, 50M, 50C, and 50K, a marking part (not shown) is provided which is used for the main body 11 to detect the type of the toner stored therein. The marking part includes at least information on the colors of the toner in the toner cartridges 50Y, 50M, 50C, and 50K and information for identifying whether it is a normal toner or a decoloring toner.

Figure 7:
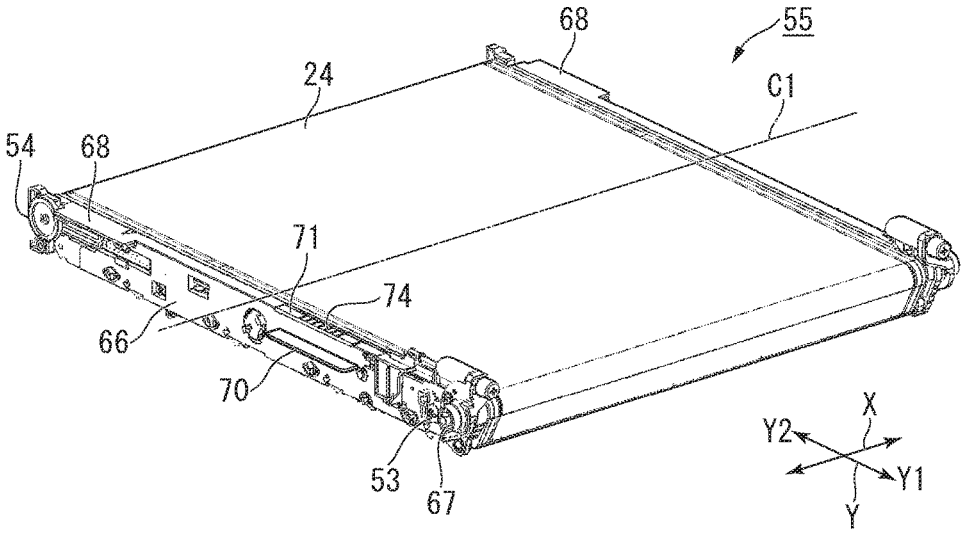
FIG. 7 is a perspective view of a transfer belt section of the image forming apparatus.

The intermediate transfer belt 24 moves cyclically. The intermediate transfer belt 24 is wrapped around a driving roller 53 and a plurality of driven rollers 54. A rotation axis C1 of the intermediate transfer belt 24 extends along the front-back direction X. As shown in FIG. 1 and FIG. 7, the intermediate transfer belt 24, the driving roller 53, and the plurality of driven rollers 54 constitute a transfer belt section (attaching/detaching section) 55. Before the transfer belt section 55 is described, a second conveyance path (conveyance path) formed in the main body 11 to draw out the transfer belt section 55 is described. The transfer belt section 55 is drawn out to a right side Y1 of the left-right direction Y.

Figure 8:
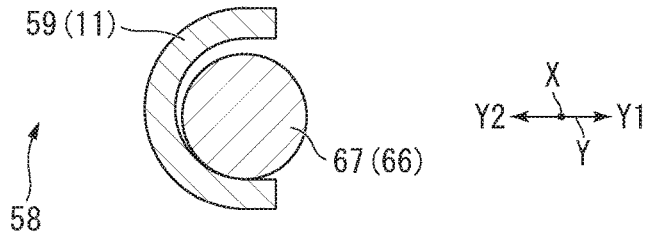
FIG. 8 is a sectional view illustrating a front view of a front side rail and a front side engagement section in the image forming apparatus.
Figure 9:
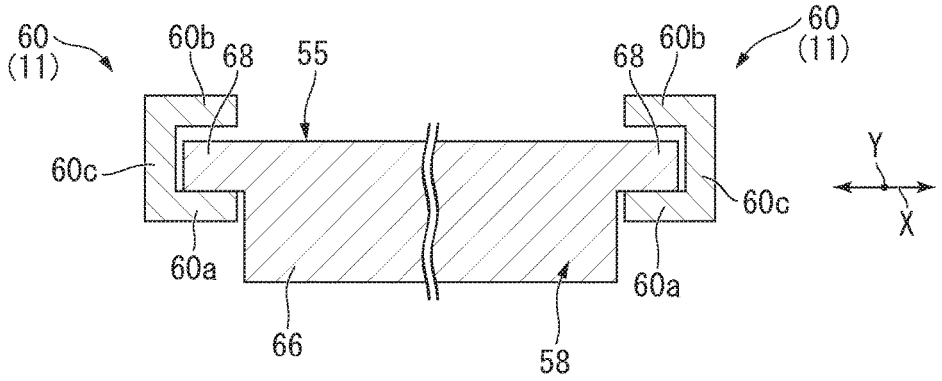
FIG. 9 is a sectional view illustrating a front view of a rear side rail and a rear side engagement section in the image forming apparatus.

As shown in FIG. 8 and FIG. 9, in the main body 11, a front side rail 59 and a rear side rail 60 are fixed. A pair of the front side rails 59 is arranged at the right side Y1 of the main body 11 at intervals in the front-back direction X. A pair of the rear side rails 60 is arranged at a left side Y2 of the main body 11 at intervals in the front-back direction X. As shown in FIG. 8, the front side rail 59 is formed into a C shape in which the right side Y1 is the opened from a front view thereof.

As shown in FIG. 9, the rear side rail 60 has a first support plate 60*a*, a second support plate 60*b*, and a connection plate 60*c*. A thickness direction of each of the support plates 60*a* and 60*b* is an up-down direction. The first support plate 60*a* is arranged below the second support plate 60*b*. The support plates 60*a* and 60*b* extend in the left-right direction Y and are spaced apart from each other in the up-down direction. The connection plate 60*c* connects outer ends of the support plates 60*a* and 60*b* in the front-back direction X. The rear side rail 60 is formed into a C shape in which the inside thereof in the front-back direction X is opened if viewed along the left-right direction Y.

A pair of the front side rails 59 and a pair of the rear side rails 60 form a second conveyance path 58 in the main body 11.

Figure 10:
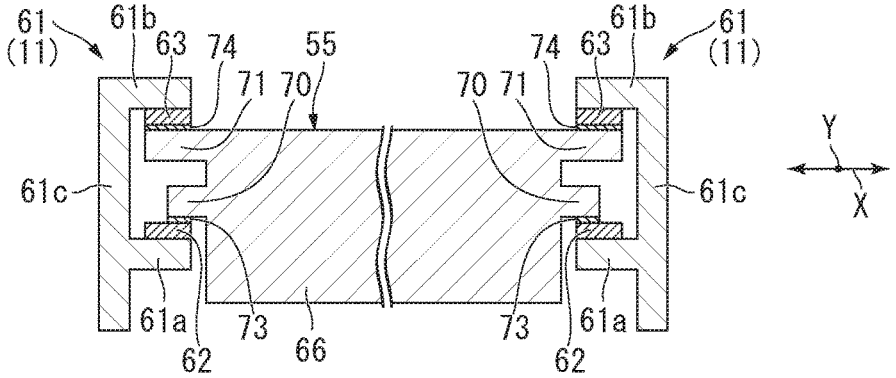
FIG. 10 is a sectional view illustrating a side view of a cleaning rail and a handle rail in the image forming apparatus.

In a part between the front side rail 59 and the rear side rail 60 in the main body 11, a cleaning rail 61 shown in FIG. 10 is fixed. The cleaning rail 61 has a first support plate 61*a*, a second support plate 61*b*, and a connection plate 61*c*. The cleaning rail 61 is constituted similarly to the rear side rail 60. If viewed along the left-right direction Y, the cleaning rail 61 is formed into an F shape in which a part between the first support plate 61*a* and the second support plate 61*b* is opened to the inside in the front-back direction X. On the upper surface of the first support plate 61*a*, a cleaning pad 62 is fixed. On the lower surface of the second support plate 61*b*, a cleaning pad 63 is fixed. The cleaning pads 62 and 63 are constituted similarly to the cleaning pad 38K described above.

The transfer belt section 55 is described again. As shown in FIG. 7, the transfer belt section 55 has a belt section main body 66 formed into a plate shape. The belt section main body 66 rotatably supports the driving roller 53 and the plurality of the driven rollers 54.

As shown in FIG. 7 to FIG. 9, a front side engagement section 67 and a rear side engagement section 68 are formed on a side surface of the belt section main body 66 facing the front-back direction X. As shown in FIG. 7 and FIG. 8, the front side engagement section 67 is arranged at an end at the right side Y1 of each side surface of the belt section main body 66. The front side engagement section 67 is formed into a cylindrical shape with the front-back direction X as an axis thereof. The front side engagement section 67 is engaged with the front side rail 59 and is detachable to the right side Y1 from an opening of the front side rail 59.

As shown in FIG. 7 and FIG. 9, the rear side engagement section 68 is formed into a plate shape and is arranged at each end at the left side Y2 of each side surface of the belt section main body 66. A thickness direction of the rear side engagement section 68 is the up-down direction. The rear side engagement section 68 extends in the left-right direction Y. The rear side engagement section 68 is arranged between the first support plate 60*a* and the second support plate 60*b* of the rear side rail 60 and is arranged on the first support plate 60*a*.

The rear side engagement section 68 is movable in the left-right direction Y with respect to the rear side rail 60.

As shown in FIG. 7 and FIG. 10, in a part between the front side engagement section 67 and the rear side engagement section 68 on the side surface of the belt section main body 66, a first handle rail 70 and a second handle rail 71 are fixed. The handle rails 70 and 71 are formed into a plate shape. A thickness direction of each of the handle rails 70 and 71 is the up-down direction. The first handle rail 70 is arranged below the second handle rail 71. The handle rails 70 and 71 are arranged at intervals in the up-down direction. The second handle rail 71 may be integrally formed with the rear side engagement section 68.

Figure 11:
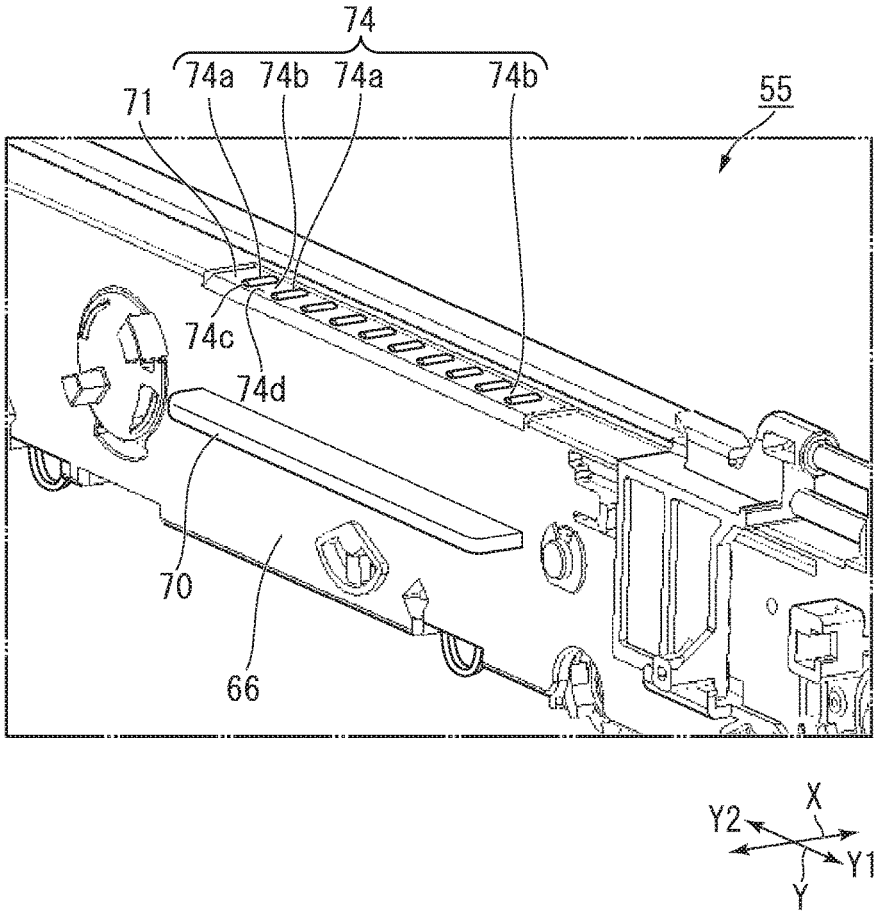
FIG. 11 is an enlarged view of the main portions in FIG. 7 in the image forming apparatus.

As shown in FIG. 7 and FIG. 10, on the lower surface of the first handle rail 70, an uneven part 73 is provided. On the upper surface of the second handle rail 71, an uneven part 74 is provided. As shown in FIG. 11, the uneven part 74 has a plurality of convex parts 74*a* and a plurality of concave parts 74*b*. The plurality of the convex parts 74*a* and the plurality of the concave parts 74*b* are alternately arranged in the left-right direction Y. The convex part 74*a* and the concave part 74*b* extend in the front-back direction X. A bottom surface 74*d* of the concave part 74*b* is positioned below an upper surface 74*c* of the convex part 74*a*.

The uneven part 73 is constituted similarly to the uneven part 74. In the uneven part 73, a bottom surface of the concave part is positioned above the lower surface of the convex part (inside the uneven part 73).

In this example, the cleaning pad 63 covers the uneven part 74 in contact with the convex part 74*a* of the uneven part 74. The cleaning pad 63 may be positioned at the right side Y1 with respect of the uneven part 74.

Although not shown, in the main body 11, an opening for taking out the transfer belt section 55 is formed. In the main body 11, a side door for blocking the opening is installed.

As shown in FIG. 2, the intermediate transfer belt 24 is in contact with the photoconductive drum 27K from the above.

At a position above the photoconductive drum 27K and opposite to the photoconductive drum 27K across the intermediate transfer belt 24, the primary transfer roller 30K is arranged. The primary transfer roller 30K is arranged inside the intermediate transfer belt 24.

If a primary transfer voltage is applied, the primary transfer roller 30K primarily transfers a toner image on the photoconductive drum 27K onto the intermediate transfer belt 24.

As shown in FIG. 1, a secondary transfer roller 77 is opposed to the driving roller 53 across the intermediate transfer belt 24. An abutment portion between the intermediate transfer belt 24 and the secondary transfer roller 77 constitutes a secondary transfer position b. The driving roller 53 rotationally drives the intermediate transfer belt 24.

A secondary transfer voltage is applied to the secondary transfer roller 77 at the time the sheet P passes through the secondary transfer position b. If the secondary transfer voltage is applied to the secondary transfer roller 77, the secondary transfer roller 77 secondarily transfers the toner image on the intermediate transfer belt 24 onto the sheet P.

As shown in FIG. 1, a transfer belt cleaner (attaching/detaching section, cleaning member) 80 is arranged at a position opposed to the driven roller 54 across the intermediate transfer belt 24. The transfer belt cleaner 80 contacts the outer peripheral surface of the intermediate transfer belt 24 to scrape off the deposit such as residual transfer toner adhering to the outer peripheral surface of the intermediate transfer belt 24. Before the transfer belt cleaner 80 is described, a third conveyance path (conveyance path) formed in the main body 11 to draw out the transfer belt cleaner 80 is described.

Figure 12:
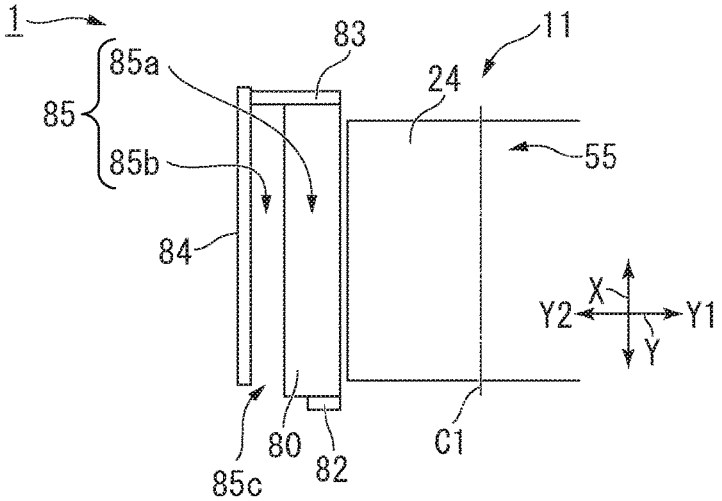
FIG. 12 is a schematic view illustrating a plan view of the main portions in the image forming apparatus.
Figure 13:
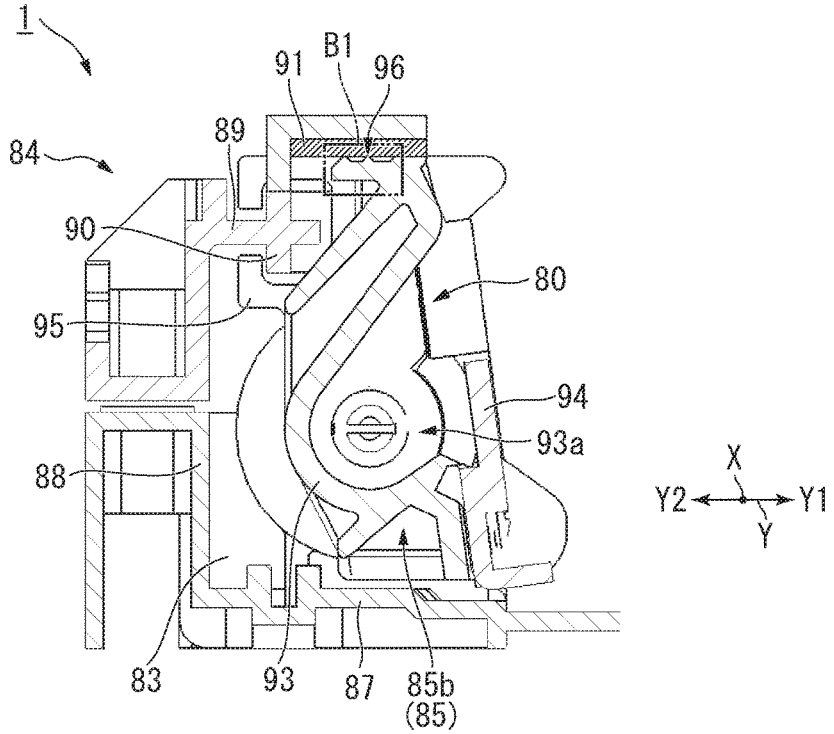
FIG. 13 is a sectional view illustrating a front view of a transfer belt cleaner and a second rail in the image forming apparatus.

As shown in FIG. 12, in the main body 11, first rails 82 and 83 extending in the left-right direction Y are fixed. The first rails 82 and 83 are arranged at intervals in the front-back direction X. The first rails 82 and 83 are positioned at the left side Y2 of the transfer belt section 55 to be adjacent to the transfer belt section 55. At the left side Y2 of the first rails 82 and 83, a second rail 84 shown in FIG. 12 and FIG. 13 is arranged. The second rail 84 extends in the front-back direction X. A first conveyance partial path 85*a* extending in the left-right direction Y is formed between the first rail 82 and the first rail 83. The transfer belt cleaner 80 moves towards and away from the outer peripheral surface of the intermediate transfer belt 24 through the first conveyance partial path 85*a*.

Figure 14:
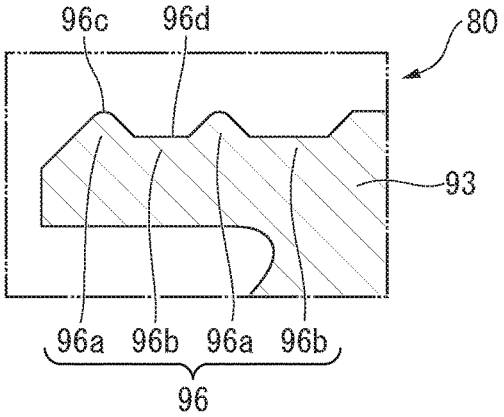
FIG. 14 is an enlarged view of B1 part in FIG. 13 of the image forming apparatus.

As shown in FIG. 13, the second rail 84 has a bottom wall 87, a side wall 88, a top wall 89, and a locking section 90. FIG. 14 shows an enlarged view of a B1 part in FIG. 13.

A thickness direction of the bottom wall 87 is an up-down direction. The side wall 88 protrudes upward from an end at the left side Y2 of the bottom wall 87. The top wall 89 protrudes from an upper end of the side wall 88 towards the right side Y1. The locking section 90 protrudes downward from the bottom surface of the top wall 89.

A cleaning pad 91 is fixed to the lower surface at the end of the right side Y1 of the top wall 89. The cleaning pad 91 is constituted similarly to the cleaning pad 38K.

A second conveyance partial path 85*b* extending in the front-back direction X is formed along the second rail 84. As shown in FIG. 12 and FIG. 13, the second conveyance partial path 85*b* and the first conveyance partial path 85*a* constitute the third conveyance path 85. The second conveyance partial path 85*b* is connected to the end at the left side Y2 of the first conveyance partial path 85*a*. The second conveyance partial path 85*b* reaches an opening 85*c* of the third conveyance path 85.

Figure 15:
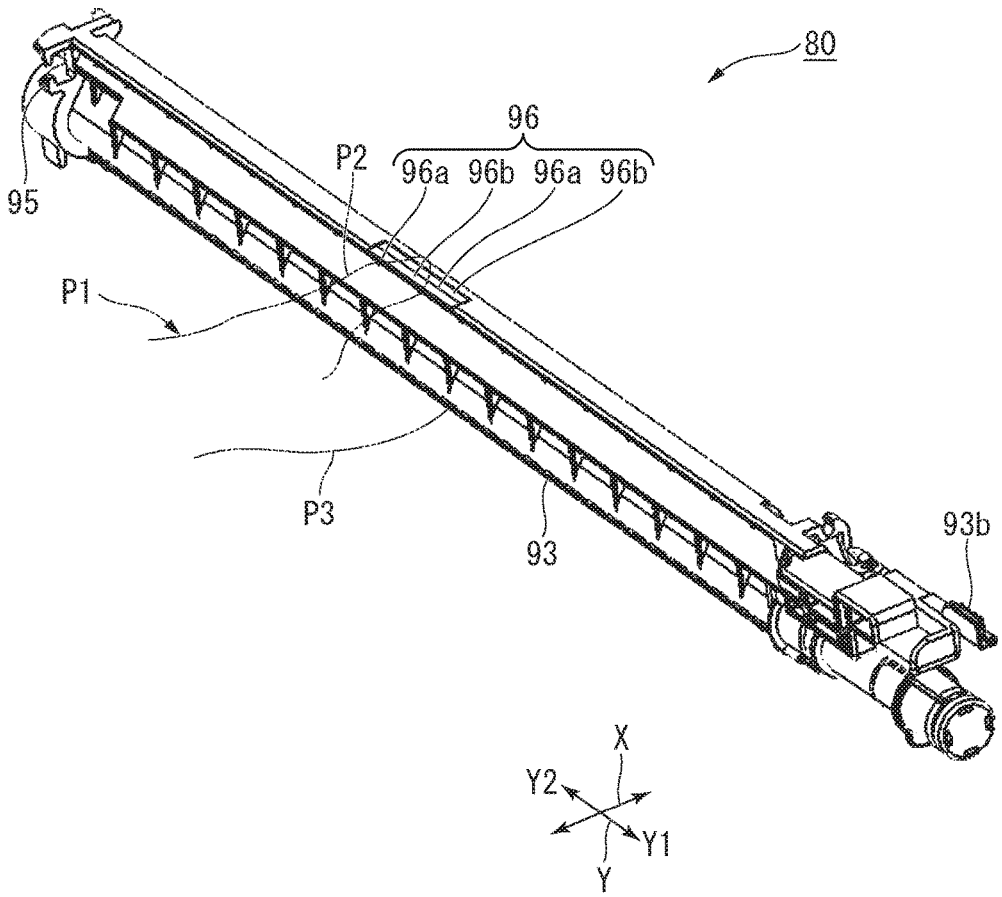
FIG. 15 is a perspective view of the transfer belt cleaner of the image forming apparatus.

As shown in FIG. 13 and FIG. 15, the transfer belt cleaner 80 has a cleaner main body 93, a blade 94, and a locked section 95. In the cleaner main body 93, a housing section 93*a* for housing the deposit is formed. The blade 94 is fixed to the cleaner main body 93. The blade 94 contacts the outer peripheral surface of the intermediate transfer belt 24. The locked section 95 protrudes upward from the outer surface of the cleaner main body 93. The locked section 95 contacts the locking section 90 of the second rail 84 from the left side Y2 of the locking section 90.

The transfer belt cleaner 80 is movable to the left side Y2 along the first rails 82 and 83 from a state in which the locked section 95 contacts the locking section 90 of the second rail 84 until the locked section 95 contacts the side wall 88.

As shown in FIG. 13 and FIG. 14, an uneven part 96 is provided on the upper surface of the cleaner main body 93. The uneven part 96 includes a plurality of convex parts 96*a* and a plurality of concave parts 96*b*. A bottom surface 96*d* of the concave part 96*b* is positioned below an upper surface 96*c* of the convex part 96*a*. The plurality of the convex parts 96*a* and the plurality of the concave parts 96*b* are alternately arranged in the left-right direction Y. The convex part 96*a* and the concave part 96*b* extend in the front-back direction X orthogonal to the first conveyance partial path 85*a*. A front end of the cleaner main body 93 is a knob 93*b* held by the user.

As shown in FIG. 1, a sheet feed roller 98A and a resist roller 99 are provided on the sheet conveyance path from the sheet feed cassette 18A to the secondary transfer roller 77. The sheet feed roller 98A conveys the sheet P taken out of the sheet feed cassette 18A by the sheet feed mechanism 19A.

The resist roller 99 aligns the tip of the sheet P fed from the sheet feed roller 98A at a mutual contact position thereof. A point a which is the mutual contact position in the resist roller 99 constitutes a resist position. If the tip of the toner image reaches the secondary transfer position b, the resist roller 99 conveys the sheet P such that the tip of a transfer area of the toner image on the sheet P reaches the secondary transfer position b.

A sheet feed roller 98B is provided on the conveyance path from the sheet feed cassette 18B to the sheet feed roller 98A. The sheet feed roller 98B conveys the sheet P taken out of the sheet feed cassette 18B by the sheet feed mechanism 19B towards the sheet feed roller 98A.

The sheet conveyance path is formed by a conveyance guide 101 between the manual sheet feed mechanism 19C and the resist roller 99. The manual sheet feed mechanism 19C conveys the sheet P taken out of the manual sheet feed unit 18C toward the conveyance guide 101. The sheet P moving along the conveyance guide 101 reaches the resist roller 99.

At the downstream side (upper side in FIG. 1) of the secondary transfer roller 77 in the conveyance direction of the sheet P, a fixing section 104 is arranged. Although not shown, the fixing section 104 has a halogen lamp and a driving motor for conveying the sheet P. The fixing section 104 fixes the toner image on the sheet P by heating the sheet P with the halogen lamp.

A conveyance roller 105 is arranged at the downstream side (upper left side in FIG. 1) of the fixing section 104 in the conveyance direction of the sheet P. The conveyance roller 105 discharges the sheet P to a sheet discharge section 106.

The inversion conveyance path 107 is arranged at the downstream side (right side in FIG. 1) of the fixing section 104 in the conveyance direction of the sheet P. The inversion conveyance path 107 reverses the sheet P to guide it to the secondary transfer roller 77. The inversion conveyance path 107 is used for duplex printing.

The constitution of a controller 111 of the image forming apparatus 1 is described.

Figure 16:
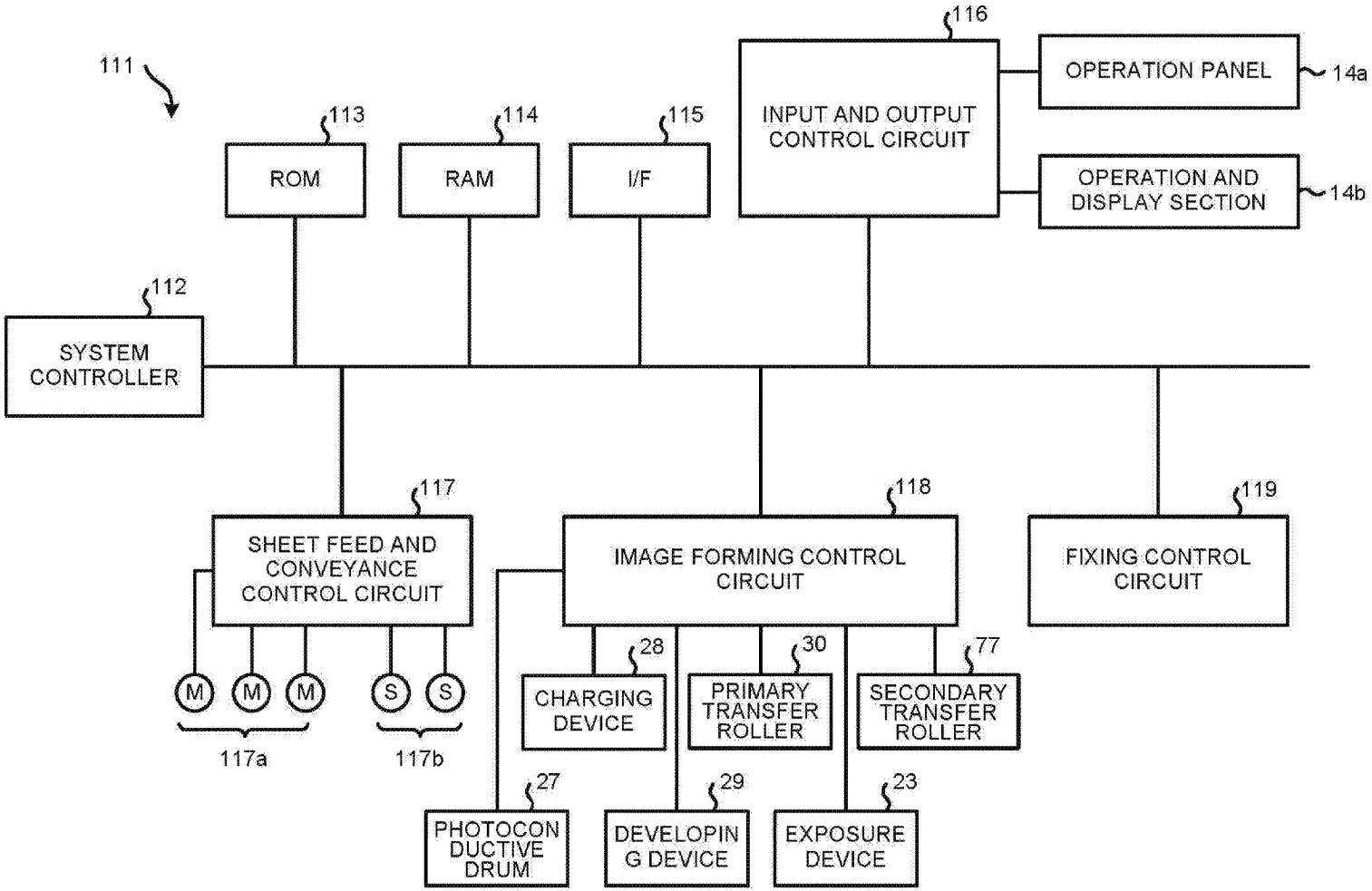
FIG. 16 is a block diagram exemplifying the constitution of a controller of the image forming apparatus.

FIG. 16 is a block diagram exemplifying the constitution of the controller 111 of the image forming apparatus 1. However, in FIG. 16, for ease of view, the members distinguished by the subscripts Y, M, C, and K are represented collectively by reference numerals from which these subscripts are deleted. For example, the photoconductive drum 27 represents the photoconductive drums 27Y, 27M, 27C and 27K. The charging device 28, the developing device 29, and the primary transfer roller 30 are also similar.

In the description with reference to FIG. 16, based on the description in FIG. 16, the reference numerals with the subscripts Y, M, C and K omitted is used in some cases.

The controller 111 includes a system controller 112, a read only memory (ROM) 113, a random access memory (RAM) 114, an interface (I/F) 115, an input and output control circuit 116, a sheet feed and conveyance control circuit 117, an image forming control circuit 118, and a fixing control circuit 119.

The system controller 112 controls the whole of the image forming apparatus 1. The system controller 112 realizes a processing function for image formation by executing a program stored in the ROM 113 or the RAM 114 described later. As the device constitution of the system controller 112, a processor such as a CPU (Central Processing Unit) or the like may be used.

The ROM 113 stores a control program, control data, and the like that govern the basic operation of the image forming processing.

The RAM 114 is a working memory in the controller 111. For example, in the RAM 114, the control program or control data of the ROM 113 is loaded as necessary. Furthermore, the RAM 114 temporarily stores the image data sent from the input and output control circuit 116 or the data sent from the system controller 112.

The I/F 115 communicates with a connection device connected to the main body 11. For example, the scanner section 15 is connected to the I/F 115 in a communicable manner. Furthermore, an external device can be connected to the I/F 115. As examples of the external devices, a user terminal, a facsimile machine, and the like are exemplified.

The input and output control circuit 116 controls the operation panel 14*a* and the operation and display section 14*b*. The input and output control circuit 116 sends an operation input received from the operation panel 14*a* and the operation and display section 14*b* to the system controller 112.

The sheet feed and conveyance control circuit 117 controls a driving system included in the main body 11. For example, the driving system includes the sheet feed mechanisms 19A and 19B, the sheet feed rollers 98A and 98B, the manual sheet feed mechanism 19C, and a driving motor 117*a* driving the resist roller 99. More preferably, a plurality of the driving motors 117*a* is provided.

A plurality of sensors 117*b* is electrically connected to the sheet feed and conveyance control circuit 117. For example, the plurality of sensors 117*b* includes a plurality of sheet detection sensors. A plurality of the sheet detection sensors is arranged inside the sheet conveyance path, the sheet feed cassettes 18A and 18B and the manual sheet feed unit 18C in the main body 11. Each of the sheet detection sensors detects the presence or absence of the sheet P at the arrangement position thereof.

The detection output of each sensor 117*b* is sent from the sheet feed and conveyance control circuit 117 to the system controller 112.

The sheet feed and conveyance control circuit 117 controls the driving motor 117*a* based on a control signal from the system controller 112 and a detection output from each sensor 117*b*.

Based on the control signal from the system controller 112, the image forming control circuit 118 controls the photoconductive drum 27, the charging device 28, the exposure device 23, the developing device 29, the primary transfer roller 30, and the secondary transfer roller 77, respectively.

The fixing control circuit 119 controls the driving motor and the halogen lamp of the fixing section 104 based on the control signal from the system controller 112.

The detail of the control executed by the controller 111 is described together with the operation of the image forming apparatus 1.

The operation of the image forming apparatus 1 constituted as stated above of the present embodiment is described. The image forming apparatus 1 prints an image on the sheet P by executing the processing in ACT 1 to ACT 17 described below.

In ACT 1, the image forming apparatus 1 reads the image data.

For example, the reading of the image data may be executed by enabling the scanner section 15 to read the original document. In this case, an operator places the original document on the document table 12 or the ADF 13. Thereafter, the operator inputs a scanning start operation of the scanner section 15 through the operation section 14. The image data read by the scanner section 15 is stored in the RAM 114 via the I/F 115.

After the image data is read, the processing in ACT 1 is terminated, and the processing in ACT 3 is executed.

In ACT 3, the operator selects which one of the sheets P housed in the sheet feed cassettes 18A and 18B and the mutual sheet feed unit 18C by operating the operation section 14. In this example, the sheet P housed in the sheet feed cassette 18A is selected.

After the sheet P is selected, the processing in ACT 3 is terminated and the processing in ACT 5 is executed.

In ACT 5, the operator inputs an instruction to start printing by operating the operation section 14.

The system controller 112 sends a control signal to start a warm-up operation of the fixing section 104 to the fixing control circuit 119. The fixing control circuit 119 starts the warm-up operation of the fixing section 104, and turns on the halogen lamp. If the warm-up operation is ended, the fixing control circuit 119 sends a conveyance permission signal of the sheet P to the system controller 112.

After the warm-up operation is completed, the processing in ACT 5 is terminated and the processing in ACT 7 is executed.

In ACT 7, the sheet P selected in ACT 3 is fed. Specifically, the system controller 112 sends a control signal to start feeding the sheet P to the sheet feed and conveyance control circuit 117. The sheet feed and conveyance control circuit 117 performs a control to feed the sheet P from the selected sheet feed cassette 18A based on the control signal from the system controller 112. The sheet P stops with a tip thereof abutting against the resist roller 99 at the secondary transfer position b.

Through the above, the processing in ACT 7 is terminated, and the processing in ACT 9 is executed.

In ACT 9, formation of the toner image on the intermediate transfer belt 24 is started. Specifically, the system controller 112 determines whether the conveyance permission signal is received from the fixing control circuit 119. If the conveyance permission signal is received, the system controller 112 sends a control signal to start forming the toner image to the sheet feed and conveyance control circuit 117, the image forming control circuit 118 and the fixing control circuit 119.

The sheet feed and conveyance control circuit 117, the image forming control circuit 118 and the fixing control circuit 119 start the control operation in parallel, respectively.

Through the above, the processing in ACT 9 is terminated, and the processing in ACT 11 is executed.

The image forming control circuit 118 starts image forming processes of the image forming sections 22Y, 22M, 22C and 22K in this order. In each of the image forming sections 22Y, 22M, 22C and 22K, electrostatic latent images are written on the surfaces of the photoconductive drums 27Y, 27M, 27C and 27K by the exposure light $L_Y$, $L_M$, $L_C$ and $L_K$ from the exposure device 23. Each electrostatic latent image is developed by developing devices 29Y, 29M, 29C and 29K.

The developed toner image is primarily transferred onto the intermediate transfer belt 24 by the primary transfer rollers 30Y, 30M, 30C and 30K. The respective toner image forming areas overlap with each other by the primary transfer. Each of the toner images stacked on the intermediate transfer belt 24 is conveyed toward the secondary transfer position b by the intermediate transfer belt 24.

Along with the operation of the image forming control circuit 118 in this way, the processing in ACT 11 is executed. In ACT 11, at a timing the toner image reaches a predetermined position, the driving motor 117*a* driving the resist roller 99 is driven by the sheet feed and conveyance control circuit 117. The rotation of the resist roller 99 is started by the driving motor 117*a*. The timing to start the rotation of the resist roller 99 is a timing at which a tip of the toner image transfer area on the sheet P reaches the secondary transfer position b if the tip of the toner image reaches the secondary transfer position b.

Through the above, the processing in ACT 11 is terminated, and the processing in ACT 13 is executed.

In ACT 13, the toner image on the intermediate transfer belt 24 is secondarily transferred onto the sheet P. Specifically, the sheet feed and conveyance control circuit 117 rotates the driving roller 53 at a predetermined linear velocity. The image forming control circuit 118 applies a secondary transfer voltage to the secondary transfer roller 77 during the time until the tip of the sheet P reaches the secondary transfer position b. The toner image is secondarily transferred onto the sheet P passing through the secondary transfer position b. The sheet P passing through the secondary transfer position b is conveyed towards the fixing section 104 along the sheet conveyance path.

The image forming control circuit 118 stops applying the secondary transfer voltage after a rear end of the sheet P passes through the secondary transfer position b. Through the above, the processing in ACT 13 is terminated.

If the sheet P passing through the secondary transfer position b enters the fixing section 104, the processing in ACT 15 is executed. In ACT 15, the fixing section 104 fixes the toner image on the sheet P.

Through the above, the processing in ACT 15 is terminated, and the processing in ACT 17 is executed.

In ACT 17, the sheet P is discharged. The sheet P discharged from the fixing section 104 reaches the conveyance roller 105. The conveyance roller 105 discharges the sheet P to the sheet discharge section 106.

Through the above, the image formation on one sheet P is terminated.

Next, a procedure for replacing the image forming section 22K of the image forming apparatus 1 with a new image forming section 22K is described after using the image forming apparatus 1 for a certain period. Thereafter, a procedure for replacing the transfer belt cleaner 80 with a new transfer belt cleaner 80 and a procedure for replacing the transfer belt section 55 with a new transfer belt section 55 are described below.

First, the user opens the front door 33. The knob 28*a*K of the image forming section 22K and the knob 93*b* of the transfer belt cleaner 80 are exposed to the outside through the opening 11*a* of the main body 11. For example, the knob 28*a*K of the image forming section 22K is held with the right hand. Since the knob 28*a*K is positioned in the vicinity of the opening 11*a* of the main body 11, the toner and a paper dust are hard to adhere thereto.

Figure 17:
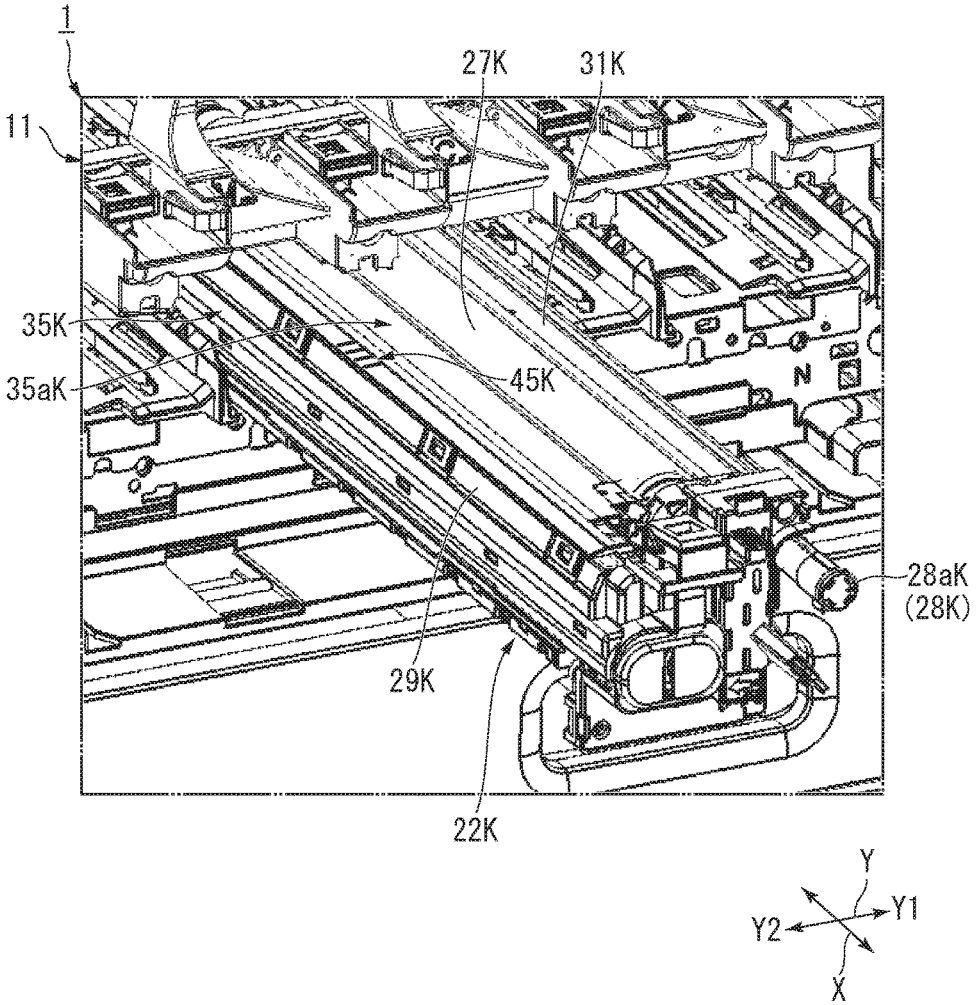
FIG. 17 is a perspective view illustrating a state of drawing out the image forming section with respect to the main body in the image forming apparatus.

As shown in FIG. 17, with respect to the main body 11, the image forming section 22K is drawn out forward along the first conveyance path 35K. The cleaning pad 38K is arranged at the position indicated by the two-dot chain line in FIG. 5, and the cleaning pad 38K slides with the upper surface 46*a*K of the convex part 46K. Since the film layer 40K is arranged on the surface of the cleaning pad 38K, the deposit A adhering to the upper surface 46*a*K of the convex part 46K hardly adheres to the cleaning pad 38K. Because the cleaning pad 38K has the foam 39K, the cleaning pad 38K tends to deform along the outer shape of the uneven part 45K. The deposit A moves backward with respect to the image forming section 22K by the cleaning pad 38K while moving downward due to gravity acting on the deposit A. The deposit A accumulates on the bottom surface 47*a*K of the concave part 47K. The upper surface 46*a*K of the convex part 46K is cleaned by the cleaning pad 38K.

At the time the image forming section 22K is drawn out to the extent that the uneven part 45K of the image forming section 22K is exposed to the outside through the opening 11*a* of the main body 11, the user carries the image forming section 22K with a left hand P1 as shown in FIG. 3. For example, four fingers P3 other than a thumb P2 of the left hand P1 support the developing device 29K of the image forming section 22K from the lower side of the developing device 29K. The thumb P2 touches the uneven part 45K from the upper side of the uneven part 45K. As shown in FIG. 5, since the thumb P2 touches only the upper surface 46*a*K of the convex part 46K, the deposit A does not adhere to the thumb P2.

The positions of the centers of gravity of the image forming section 22K and the uneven part 45K and the position of the uneven part 45K are equal to each other in the front-back direction X. Therefore, by supporting the position of the uneven part 45K in the front-back direction X with the left hand P1 by the user, the masses of the image forming section 22K and the uneven part 45K are not biased in the front-back direction X, and it is possible to easily support the image forming section 22K and the uneven part 45K.

The user draws out the image forming section 22K with both hands while supporting it to remove the image forming section 22K from the main body 11. The new image forming section 22K is supported similarly with both hands and the image forming section 22K is pushed backward along the first conveyance path 35K with respect to the main body 11, and thus, the image forming section 22K is mounted in the main body 11.

Through the above steps, the replace of the image forming section 22K is completed.

Next, the procedure for replacing the transfer belt cleaner 80 is described.

For example, the user holds the knob 93*b* of the transfer belt cleaner 80 with the right hand. The transfer belt cleaner 80 is moved to the left side Y2 along the first conveyance partial path 85*a* with respect to the main body 11. The blade 94 of the transfer belt cleaner 80 is separated from the outer peripheral surface of the intermediate transfer belt 24. Since the cleaning pad 91 slides with the upper surface 96*c* of the convex part 96*a*, the upper surface 96*c* of the convex part 96*a* is cleaned. Since the convex part 96*a* and the concave part 96*b* extend in the front-back direction X, if the transfer belt cleaner 80 is moved to the left side Y2, the upper surface 96*c* of the convex part 96*a* can be cleaned in a wide range in the front-back direction X of the cleaning pad 91.

If the locked section 95 of the transfer belt cleaner 80 is locked in the side wall 88 of the second rail 84, the transfer belt cleaner 80 is moved forward along the second conveyance path 85*b* with respect to the main body 11. The transfer belt cleaner 80 is drawn out forward to the extent that the uneven part 96 of the transfer belt cleaner 80 is exposed to the outside through the opening 11*a* of the main body 11. As shown in FIG. 15, the user holds the transfer belt cleaner 80 with the left hand P1. For example, the cleaner main body 93 of the transfer belt cleaner 80 is supported with four fingers P3 on the left hand P1 from the lower side of the cleaner main body 93. The thumb P2 touches the uneven part 96 from the upper side of the uneven part 96. Since the thumb P2 touches only the upper surface 96*c* of the convex part 96*a*, the deposit A does not adhere to the thumb P2. The user draws out the transfer belt cleaner 80 forward with both hands while supporting it to remove the transfer belt cleaner 80 from the main body 11.

The user similarly supports the new transfer belt cleaner 80 with both hands and pushes the transfer belt cleaner 80 backward along the second conveyance partial path 85*b* with respect to the main body 11. The transfer belt cleaner 80 is moved along the first conveyance partial path 85*a* to the right side Y1 and the blade 94 of the transfer belt cleaner 80 contacts the outer peripheral surface of the intermediate transfer belt 24.

With the above steps, the transfer belt cleaner 80 is replaced.

Next, the procedure for replacing the transfer belt section 55 is described.

First, the user opens the side door. The end at the right side Y1 of the transfer belt section 55 is held with both hands as the knob. Since the end at the right side Y1 of the transfer belt section 55 is positioned in the vicinity of the opening of the main body 11, the toner and the paper dust are difficult to adhere thereto.

The transfer belt section 55 is moved to the right side Y1 along the second conveyance path 58 with respect to the main body 11. The front side engagement section 67 of the transfer belt section 55 is removed to the right side Y1 with respect to the front side rail 59 of the main body 11. The rear side engagement section 68 is moved along the rear side rail 60 to the right side Y1. The upper surface 74*c* of the uneven part 74 is cleaned by the cleaning pad 63. The uneven part 73 is also cleaned by the cleaning pad 62.

If the transfer belt section 55 is drawn out to the extent that the uneven parts 73 and 74 of the transfer belt section 55 are exposed to the outside through the opening of the main body 11, the user holds the uneven parts 73 and 74 of the transfer belt section 55 as the handles with both hands. The user draws out the transfer belt section 55 with both hands while supporting it to remove the transfer belt section 55 from the main body 11. The user similarly supports the new transfer belt section 55 with both hands and pushes the transfer belt section 55 along the second the conveyance path 58 to the left side Y2 with respect to the main body 11 to mount the transfer belt section 55 in the main body 11.

Through the above steps, the replacement of the transfer belt section 55 is completed.

In the conventional image forming apparatus, there is a problem that the deposit A adheres to the hand of the user at the time of replacing the image forming section 22K and the like.

On the other hand, according to the image forming apparatus 1 of the present embodiment, if the image forming section 22K housed in the main body 11 is drawn out along the first conveyance path 35K, the deposit A adhering to the convex part 46K of the uneven part 45K along which the cleaning pad 38K slides is housed in the concave part 47K. Since the user holding the image forming section 22K is difficult to touch the inside of the concave part 47K, it is possible to prevent the deposit A from adhering to the user holding the image forming section 22K.

As the uneven part 45K can be cleaned just by fixing the cleaning pad 38K to the image forming apparatus 1, a manufacturing cost of the image forming apparatus 1 can be reduced.

In the uneven part 45K, the convex part 46K1 is arranged at a position (forward) closer to the opening 35*a*K than the concave part 47K1 along the first conveyance path 35K. In this way, it is possible to easily house the deposit A adhering to the upper surface 46*a*K of the convex part 46K1 in the concave part 47K1.

The positions of the centers of gravity of the image forming section 22K and the uneven part 45K and the position of the uneven part 45K are equal to each other in the front-back direction X. The user supports the position of the uneven part 45K in the front-back direction X, and thus, the masses of the image forming section 22K and the uneven part 45K are not biased in the front-back direction X, and the image forming section 22K and the uneven part 45K can be easily supported.

The gap SK is formed between the cleaning pad 38K and the image forming section 22K. Therefore, the cleaning pad 38K does not contact the image forming section 22K, and the cleaning pad 38K can intensively clean the deposit A on the uneven part 45K.

The uneven part 45K is positioned behind the cleaning pad 38K. Therefore, the cleaning pad 38K is prevented from coming into contact with members other than the uneven part 45K, and the cleaning pad 38K can intensively clean the uneven part 45K.

The cleaning pad 38K has the foam 39K and the film layer 40K. In this way, the cleaning pad 38K can easily deform along the outer shape of the uneven part 45K and also prevent the deposit A from adhering to the cleaning pad 38K.

If the attaching/detaching section is the transfer belt cleaner 80, the convex part 96*a* and the concave part 96*b* of the uneven part 96 are formed to extend in the front-back direction X. In this way, the thumb P2 of the user touching the uneven part 96 is difficult to slide from the uneven part 96 to the left-right direction Y.

In the transfer belt section 55, the cleaning pad 63 covers the uneven part 74 while contacting the convex part 76 of the uneven part 74. Therefore, the deposit A can be difficult to adhere to the uneven part 74.

Figure 18:
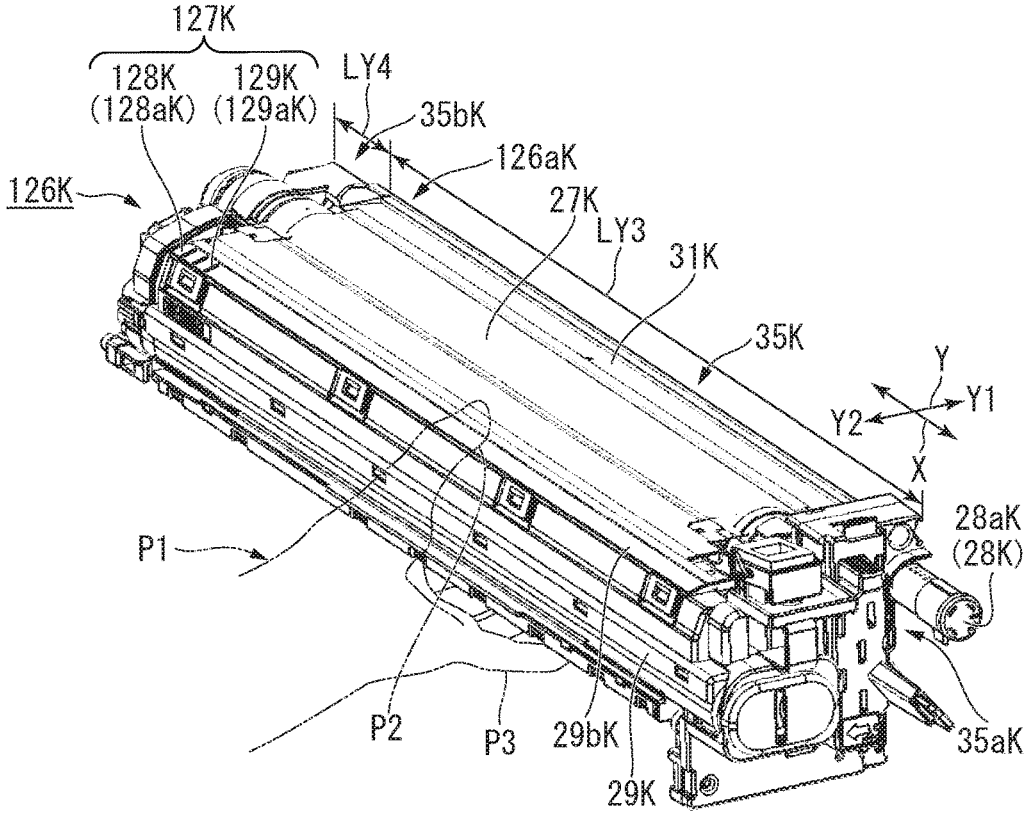
FIG. 18 is a perspective view illustrating an image forming section in a modification of the image forming apparatus.

In the present embodiment, an image forming section 126K shown in FIG. 18 may be used. An upper surface 29*b*K of the developing device 29K is a part for sliding which slides with the cleaning pad 38K. No gap is formed between the upper surface 29*b*K and the cleaning pad 38K.

An uneven part 127K is arranged at a rear end 126*a*K where a distance LY4 from a rear part 35*b*K along the first conveyance path 35K is shorter than a distance LY3 from the opening 35*a*K along the first conveyance path 35K in the image forming section 126K. In this case, an upper surface 128*a*K of the convex part 128K is in the same plane as the upper surface 29*b*K of the developing device 29K. A bottom surface 129*a*K of a concave part 129K is positioned below the upper surface 128*a*K.

In the image forming section 126K of the modification, the upper surface 29*b*K of the developing device 29K and the upper surface 128*a*K of the convex part 128K are cleaned by the cleaning pad 38K. At this time, the deposit A is housed in the concave part 129K.

The user holds an intermediate portion in the front-back direction X of the image forming section 126K, and the thumb P2 contacts the upper surface 29*b*K of the developing device 29K. Since the upper surface 29*b*K is cleaned by the cleaning pad 38K, even if the thumb P2 touches the upper surface 29*b*K, the adhesion of the deposit A to the user is suppressed. Since the concave part 129K in which the deposit A is housed is separated from the part held by the user in the image forming section 126K, it is possible to more reliably prevent the deposit A from adhering to the user.

The cleaning pad 38K may be arranged at the front end (opening 35*a*K) of the first conveyance path 35K.

There is no limit to the number of the convex parts and the concave parts constituting the uneven part, and each may be one.

According to at least one embodiment described above, by including the uneven parts 45K, 73, 74 and 96 and the cleaning pads 38K, 62, 63 and 91, it is possible to prevent the deposit A from adhering to the user holding the image forming section 22K, the transfer belt section 55 and the transfer belt cleaner 80.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

a main body having a conveyance path therein;

an attaching/detaching section, housed in the main body, configured to be detachably drawn out with respect to the main body along the conveyance path;

an uneven part, arranged in the attaching/detaching section, comprising a convex part and a concave part; and a cleaning member, arranged in the main body, slidable with respect to the convex part in a direction in which the attaching/detaching section moves along the conveyance path, the main body has an opening through which the attaching/detaching section is attached or detached and a rear part at an opposite side to the opening in the conveyance path, the attaching/detaching section has a part which slides with the cleaning member, and the uneven part is arranged at an end where a distance from the rear part along the conveyance path is shorter than a distance from the opening along the conveyance path in the attaching/detaching section.

2. The image forming apparatus according to claim 1, wherein the convex part is arranged at a position closer to the opening than the concave part along the conveyance path.

3. The image forming apparatus according to claim 1, wherein positions of the centers of gravity of the attaching/detaching section and the uneven part and a position of the uneven part are equal to each other in a direction in which the attaching/detaching section is drawn out to the outside of the main body through the opening from the main body.

4. The image forming apparatus according to claim 1, wherein a gap is present between the cleaning member and the attaching/detaching section.

5. The image forming apparatus according to claim 1, wherein the cleaning member is arranged at a position adjacent to the uneven part, and a distance between the opening and the uneven part along the conveyance path is longer than a distance between the opening and the cleaning member along the conveyance path.

6. The image forming apparatus according to claim 1, wherein the cleaning member comprises a foam and a resin film layer formed on a surface of the foam.

7. The image forming apparatus according to claim 1, wherein the cleaning member comprises a nonwoven fabric.

8. The image forming apparatus according to claim 1, wherein the main body has a rotating body, the attaching/detaching section is a cleaning section that contacts an outer peripheral surface of the rotating body to scrape off deposits adhering to the outer peripheral surface of the rotating body, the conveyance path has a first conveyance partial path extending in a direction orthogonal to a rotation axis of the rotating body and along which the cleaning section moves towards and away from the outer peripheral surface of the rotating body, and a second conveyance partial path connected to an end of the first conveyance partial path and extending along the rotation axis of the rotating body to reach the opening, and the convex part and the concave part extend in a direction orthogonal to the first conveyance partial path.

9. The image forming apparatus according to claim 1, wherein the cleaning member covers the uneven part while contacting the convex part.

10. The image forming apparatus according to claim 1, further comprising:

a color toner.

11. The image forming apparatus according to claim 1, further comprising:

a decoloring toner.

* * * * *